United States Patent [19]

Stickle, Jr.

[11] 4,025,053

[45] May 24, 1977

[54] SCREW ACTUATED SCISSOR JACK WITH A SELF ADJUSTING BEARING SURFACE

[76] Inventor: Warren Edward Stickle, Jr., 134 Somerset St., Somerville, N.J. 08876

[22] Filed: May 10, 1976

[21] Appl. No.: 684,541

[52] U.S. Cl. ..... 254/122; 254/126; 254/133 R; 254/DIG. 4

[51] Int. Cl.[2] ..... B66F 3/22

[58] Field of Search ..... 254/122, 126, 9 R, 9 B, 254/9 C, 133, 134, DIG. 4

[56] References Cited

UNITED STATES PATENTS

| | | | |
|---|---|---|---|
| 2,546,361 | 3/1951 | Floyd | 254/126 |
| 2,929,519 | 3/1960 | Taylor | 254/9 C |
| 2,931,519 | 4/1960 | Beach | 254/134 |

FOREIGN PATENTS OR APPLICATIONS

| | | |
|---|---|---|
| 1,195,412 | 5/1959 | France |

*Primary Examiner*—Al Lawrence Smith
*Assistant Examiner*—Robert C. Watson
*Attorney, Agent, or Firm*—Henry J. Walsh

[57] ABSTRACT

There is disclosed a scissor-type screw actuated jack arrangement having a floating load bearing plate centrally situated over supporting lift arms when in the fully extended position and a pair of facing U-shaped channel members coupled to opposite ends of the lift arms for carrying the bearing plate and screw.

3 Claims, 5 Drawing Figures

SCREW ACTUATED SCISSOR JACK WITH A SELF ADJUSTING BEARING SURFACE

BACKGROUND OF THE INVENTION

This invention pertains to portable devices for raising and sustaining for long periods in a raised position parts of machines, and more particularly, to an improved and strengthened scissor jack for lifting automobiles or tractors from a position beneath such parts.

As is well known, automotive parts such as engines, transmissions, differentials, etc., are generally too heavy to be lifted without some mechanical assistance. In addition, it is frequently impossible to lift these parts from above by a hoist or overhead lifting device because such parts are inaccessible, or because a breakdown has occurred in some remote place. Therefore, it has become fairly common to use a lifting jack which, when fully collapsed, can be placed easily under a car and raised from that position to lift the car or any part thereof off the ground.

Generally, portable jacks which may be transported in the trunk of an automobile and are widely available to the consuming public, are characteristically made for emergency use rather than everyday use. These jacks employ compromising design structures which will fatigue if used repeatedly. Some of these portable jacks represent substantial hazards to the user because of improper designs which can cause the jack to shift off center in actual use.

Accordingly, it is an object of this invention to provide an improved jack design that is both strong, stable, an durable which can be produced in quantities at relatively low costs.

It is also an object of this invention to furnish a portable scissor jack which compensates for shifts in a lifted load thereby avoiding tilting, or off-center, loads from prematurely collapsing the jack.

SUMMARY OF THE INVENTION

These as well as other objects are accomplished in the preferred embodiment of my invention, disclosed in detail hereinafter, which includes two channel members held in spaced relationship by pairs of scissor lifting arms which are screw actuated. The top channel member carries a floating load bearing platform which rides on lubricated metal strips and is movable a limited distance constrained by integral downwardly extending stop pins stationed in elongated openings of the top member. The floating platform is designed to carry the load and is approximately centrally situated over the lifting arms when in the fully extended position. The bottom channel serves as the base support for the jack providing a relatively large surface in contact with the surface to improve stability.

BRIEF DESCRIPTION OF THE DRAWING

Referring now to the drawing, the objects and features of the invention can be better appreciated from a careful consideration of the drawing which includes.

DETAILED DESCRIPTION

Figure 1:
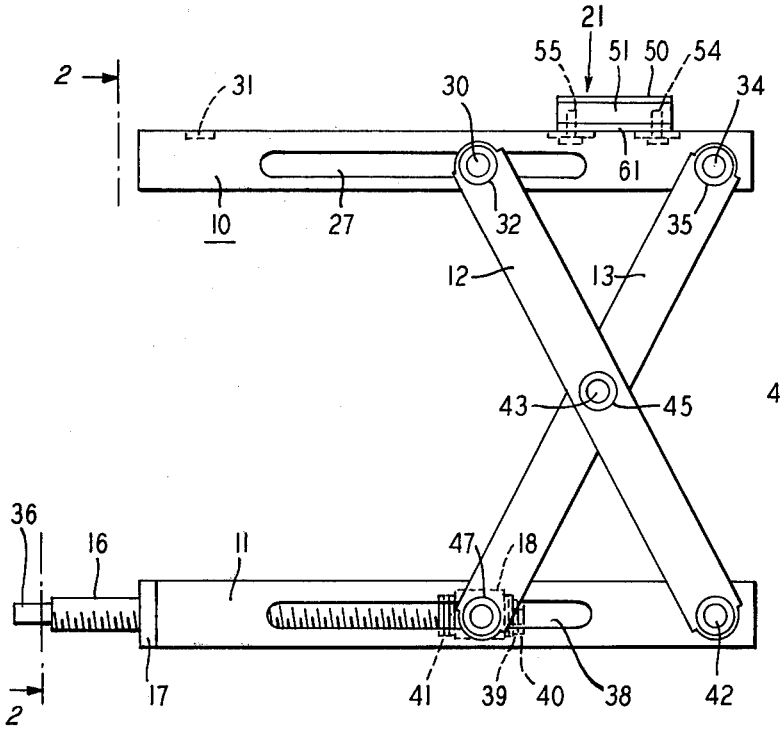
FIG. 1 depicting a side view of my jack arrangement in almost a fully extended position.
Figure 2:
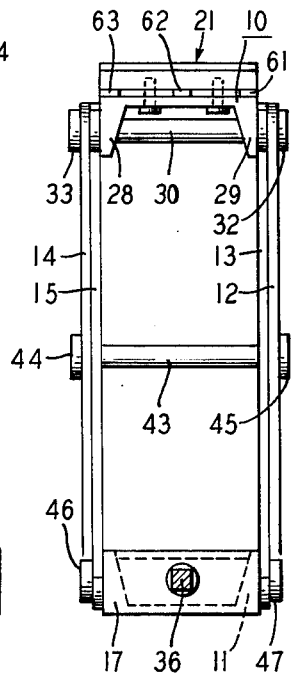
FIG. 2 showing a front view taken along section lines 2—2 of FIG. 1 to depict the hand crank adapter at the bottom thereof as well as the axles supporting the lifting arms.

Considering FIG. 1 initially, it discloses a top U-shaped channel member 10 supported above a similarly shaped, but inverted, channel member 11 which serves as a base. U-shaped channel members were chosen in my design because of their known resistance to bending with off-set load and to other distortions, such as twisting. A profile end view of member 10 may be best seen in FIG. 2. Member 10 is supported apart from (or close to) member 11 by pairs of lifting arms 12 and 13, and arms 14 and 15. In FIG. 1, arms 12 and 13 are easily seen, but arms 14 and 15, which are aligned directly behind them, cannot be seen. The symmetrical positioning of these pairs of lifting mechanisms can be appreciated from the view in FIG. 2.

Member 11 carries threaded shaft 16 which is in threaded engagement with threaded plate 17 and bottom forward axle 18. The latter is largely blocked from view in FIG. 1 by the bottom portion of arm 13, but may be seen in FIG. 5 in a cutaway section showing shaft 16, axle 18 and arms 13 and 15 together with force-fitting caps 19 and 20. The latter can be replaced by any suitable fastener, e.g., nut and washer arrangement. The horizontal section of U-shaped member 11 touches the ground when in use and serves as the base support for the jack. Its relatively large surface imrpoves the stability of the jack.

Figure 3:
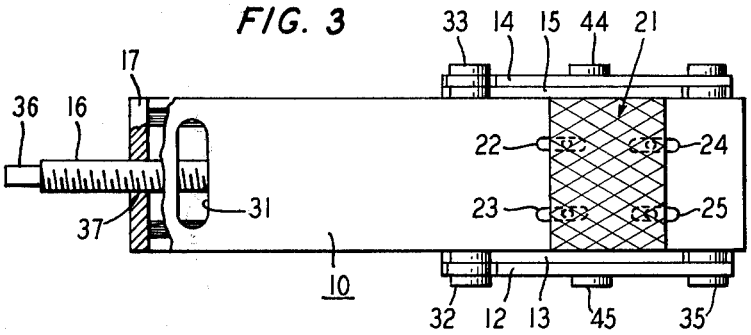
FIG. 3 showing a top view of the jack displaying to the right side of the figure the load bearing platform in relation to the lifting screw.
Figure 4:
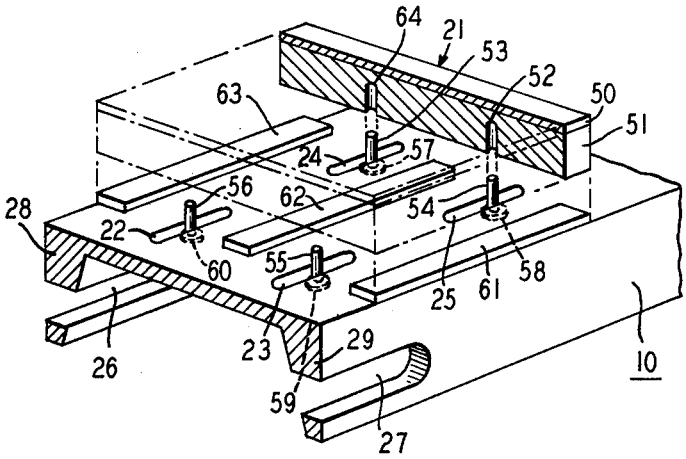
FIG. 4 depicting in section line outline the shape of the platform as well as the supporting arrangement thereof.

Sitting atop member 10 is bearing platform 21 which has diamond shaped etching (see FIG. 3) on its top surface to improve surface friction. Platform 21 is movably mounted on member 10, as will be described in greater detail hereinafter. Platform 21 engages the load to be lifted, and advantageously, in accordance with a feature of this invention, it is movable guided along elongated openings in member 10. As will be discussed in further detail, these openings, numbered 22–25, are shown in FIG. 4.

It should be noted that five axles (numbered 18, 30, 34, 42, and 43) are used at each pivot or slide to give maximum lateral stability to the design and to afford built-in low friction bearings which tend to rotate as the jack is raised or lowered.

The advantage of the mobility of platform 21 may be appreciated if we consider the problems of lifting a car bumper to change a tire. The jack is placed under the car frame nearest the tire to be removed. As the jack lifts the car, one corner of the car tilts upward, but the other tires remain in contact with the ground. In actual fact, the load contact (touching platform 21) being a fixed distance from the tires in contact with the ground, travels through an arc, and does not move truely vertically up and down. While it is true that the radius of the arc is large relatively speaking, there is a slight horizontal displacement. As the car is lifted higher, the displacement increases and eventually the jack tilts and falls. The car brakes ordinarily left unset to allow for this problem, but that solution is manifestly hazardous.

In this arrangement, platform 21 moves to compensate for the displacement of the load.

Returning to the detailed consideration, member 10 has a pair of top guide slots 26 and 27 midway along downwardly projecting legs 28 and 29. Slot 27 is visible in FIG. 1 and portions of both slots 26 and 27 may be seen in FIG. 4. Slots 26 and 27 are of equal length and size, and are symmetrically positioned along respective legs 28 and 29. Slots 26 and 27 serve as guides and stops for top forward axle 30 (see FIG. 2). As shown in FIG. 1, the jack is approximately 80 percent of its full height which is reached when forward axle 30 is positioned at the extreme right side of slots 26 and 27. Axle 30 is rotatably mounted to arms 12 and 15 by fastener collars 32 and 33.

Member 10 has a cutout 31 (seen best in FIG. 1) which is used as a convenient grip to move the jack when collapsed. Advantageously, when the jack is fully collapsed (axle 30 moved to extreme left position of slot 27), member 10 is nearly in touching relationship to member 11, providing a convenient assembly for storage until needed.

Member 10 is also fitted with a rearward axle 34 rotatably mounted in openings (not shown) therein. Axle 34 is held in position by collars (collar 35 only can be seen) which also hold lift arms 13 and 15 at their respective upper ends allowing them to pivotally rotate about axle 34.

Figure 5:
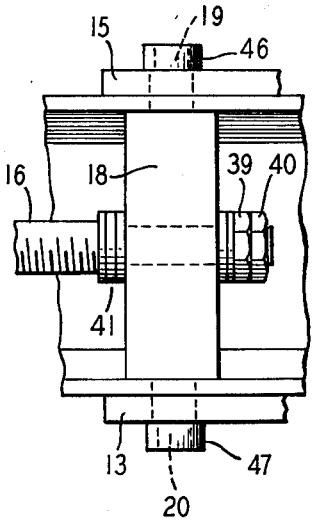
FIG. 5 showing the screw joined to a transverse axle for translating horizontal displacement to vertical lift displacement.

Lift arms 12 and 13 cooperate with lift arms 14 and 15 to translate the horizontal displacement of threaded shaft, or screw, 16 into transverse displacement of member 10 with respect to member 11. Threaded shaft 16 has a reduced diameter at one end which has been given the shape of a rectangular adapter 36 suitable to fit conventional hand cranks. As shaft 16 is turned it advances horizontally (to right for raising and to left for lowering) and axle 18 which is secured as shown in FIG. 5, also moves horizontaly along bottom guide slot 38 and a mating guide slot opposite it in member 11. Axle 18 is secured to shaft 16 as shown by a pair of nuts 39 and 40 (acting together as a lock nut) and oil-less bearing thrust washer 41. Thus, as axle 28 moves restrained by rear axle 42 and central axle 43 and their respective assemblies, the scissor formed by arms 12 and 13 opens (lowers) and closes (lifts).

Turning our attention now to FIG. 4 and to platform 21, we can see in phantom outline the shape of top plate 50 secured to block 51. Platform 21 rides on three bronze strips 61–63 which have been impregnated by a lubricant which is released in small but sufficient amounts under load. Plate 50 may be composed of hardened metals which are uniquely adapted to the expected load stresses. There are four bottom drill holes in block 51 (only holes 52 and 64 are shown) positioned to receive stop pins 53–56. During assembly, pins 53–56 are fitted in block 51 and block 51 is positioned so that pins 53–56 protrude downwardly into openings 22–25. Stop collars 57–60 are inserted (force-fitted), welded, or otherwise permanently secured to pins 53–56 to prevent removal of platform 21 from member 10. Obviously, pins 53–56 and collars 57–60 could be made as unitary assemblies, if desired, and driven (or screwed, if block 51 is priorly taped) into block 51. These, as well as other variations are believed to be within the scope and spirit of the disclosed invention.

I claim:

1. A scissor jack arrangement comprising a pair of facing plate members relatively movable toward and away from each other, pairs of arms pivotally joined at their respective midsections and at their rearward lower and upper ends to ends of said plate members, forward ends of said pairs of arms being slidably joined to each of said facing plate members through an elongated slot opening associated therewith, an axle running transvese to said pairs of arms and slidably connected to each forward lower end of each of said arms, a threaded plate at an end opposite to where said rearward arm is pivotally joined to a lower one of said plate members, a threaded shaft being threaded into said threaded plate and fixedly secured to said axle for movement of forward and rearward ends of said respective arms toward and away from each other, a floating loadbearing platform slidably mounted on a top one of said plate members for movement longitudinally therealong, and said platform includes downwardly extending securement pins interfitted with elongated apertures in said top plate member situated substantially centrally between said pair of arms, and lubricating strips running longitudinally between said top plate member and said platform for self-lubricating movement of said platform.

2. A scissor jack assembly comprising an upper load-bearing plate member and a lower plate member joined by a pair of collapsible scissor structures;

each of said scissor structures including a pair of arms pivotally joined at their respective midsections, end sections of said arms on each of said structures being pivotally joined to rearward sections on said bearing plate member and said lower plate member, and opposite end sections of said arms on each of said structures being slidably joined to opposite plate members;

a threaded shaft being fixedly secured to the opposite end sections of said arms on each of said structures;

a mating threaded member secured to said lower plate member for relative movement of said bearing plate member with respect to said lower plate member as said threaded shaft is turned engaged in said mating threaded member;

a floating load bearing platform slidably mounted on said load-bearing plate member for restricted movement therealong; and lubricating strips between said upper load-bearing plate member and said platform for self-lubricating movement of said platform.

3. The invention recited in claim 2 further including securement pins projecting downwardly from said load-bearing plate member, and interfitting elongated apertures in said upper load-bearing plate member for restricted motion of said platform.

* * * * *